US005426485A

United States Patent [19]

Fujita et al.

[11] Patent Number: 5,426,485

[45] Date of Patent: Jun. 20, 1995

[54] CLEANING DEVICE FOR A TRANSFER BELT OF AN IMAGE FORMING APPARATUS

[75] Inventors: Shigeo Fujita; Ryuji Wataki; Noritaka Okazaki; Yuki Itoh, all of Osaka, Japan

[73] Assignee: Mita Industrial Co., Ltd., Osaka, Japan

[21] Appl. No.: 147,202

[22] Filed: Nov. 3, 1993

[30] Foreign Application Priority Data

Nov. 16, 1992 [JP] Japan ..... 4-305560

[51] Int. Cl.[6] ..... G03G 15/14

[52] U.S. Cl. ..... 355/208; 198/499; 355/271; 355/299

[58] Field of Search ..... 355/275, 299, 212, 215, 355/30, 208, 271, 274; 198/497, 499; 474/92

[56] References Cited

U.S. PATENT DOCUMENTS

| | | | |
|---|---|---|---|
| 4,407,580 | 10/1983 | Hashimoto et al. | 355/275 |
| 4,520,917 | 6/1985 | Sillivent et al. | 355/299 X |
| 4,527,887 | 7/1985 | Vineski | 355/299 |
| 4,547,064 | 10/1985 | Ammenheuser et al. | 355/299 |
| 4,630,920 | 12/1986 | Silverberg et al. | 355/299 |
| 4,866,483 | 9/1989 | Davis et al. | 355/299 |
| 5,121,166 | 6/1992 | Miyamoto et al. | 355/299 X |
| 5,138,363 | 8/1992 | Yuge | 355/275 X |
| 5,268,725 | 12/1993 | Koga et al. | 355/275 |

FOREIGN PATENT DOCUMENTS

| | | | |
|---|---|---|---|
| 0129373 | 6/1988 | Japan | 355/275 |
| 0129376 | 6/1988 | Japan | 355/275 |
| 0068976 | 3/1991 | Japan | 355/275 |
| 0133081 | 5/1992 | Japan | 355/275 |

*Primary Examiner*—Robert B. Beatty
*Attorney, Agent, or Firm*—Jordan and Hamburg

[57] ABSTRACT

A cleaning device for cleaning an endless transfer belt which is made of elastic material and stretched between a first roller and a second roller, one of the two rollers being adapted for driving the belt, the transfer belt being able to come into contact with a copy sheet on one stretch side of the transfer belt to convey the copy sheet in a direction from the first roller to the second roller. The cleaning device is provided with a cleaning blade member for removing toner from the belt. The cleaning blade member is disposed on the other stretch side of the transfer belt and near the second roller, being pressed perpendicularly against an outside surface of the belt, and having a leading end portion which is flexed and capable of coming into a line contact with the belt over an entire width of the belt when the belt is driven. The amount of pressing force of the blade against the belt will be adjusted depending on the sensed temperature of the belt.

9 Claims, 8 Drawing Sheets

CLEANING DEVICE FOR A TRANSFER BELT OF AN IMAGE FORMING APPARATUS

BACKGROUND OF THE INVENTION

The present invention relates to a cleaning device for a transfer belt which is constructed so as to transfer a toner image formed on the surface of a photosensitive member to a copy sheet while transporting the copy sheet in an image forming apparatus such as a copying machine and a printer.

There have been known conventionally image forming apparatuses such as copying machines and printers having a so-called transfer belt made of elastic material. This transfer belt transports a copy sheet fed through a pair of registration rollers from a cassette to a photosensitive drum. The transfer belt, to which a voltage of a specified level is applied, causes a toner image developed by a developing device and formed on the surface of the photosensitive drum to be transferred to the copy sheet, and then transports the copy sheet to a fixing device.

In the above apparatus, toner attached electrostatically to the surface of the photosensitive drum and that from the developing device may fly away and attach to the surface of the transfer belt. This causes the photosensitive drum and the rear face of the copy sheet to be stained. In view of this problem, the apparatus is provided with a cleaning device including a cleaning blade which is brought into pressing contact with the surface of the transfer belt to scratch off the attached toner. As a cleaning device employing a cleaning blade as mentioned above, there are in general two types: a counter type and a trail type. In the counter type cleaning device, as shown in FIG. 8, a cleaning blade 53 is disposed tiltingly such that a leading end thereof is in pressing contact with the surface of a transfer belt 50 at the bottom of the circumferential surface of a drive roller 51 for rotating the transfer belt 50 and is located backward relative to a base end thereof with respect to a rotating direction of the transfer belt 50 (a direction of arrow in FIG. 8).

In a trail type cleaning device, as shown in FIG. 9, a cleaning blade 54 is disposed tiltingly such that a leading end thereof is in pressing contact with the surface of a transfer belt 50 at a position of a placing member 55 disposed between the drive roller 51 and a driven roller 52 where the transfer belt 50 is stretched and is located forward relative to a base end thereof with respect to the rotating direction of the transfer belt 50 (a direction of arrow in FIG. 9).

In the above cleaning devices, the leading ends of the cleaning blades 53, 54 are fabricated to have an edge of a desired angle, e.g., right angle, with high accuracy. Thus, a mounting angle is important in bringing the cleaning blades in pressing contact with the transfer belt 50. In other words, an optimal cleaning function cannot be obtained in the case where the cleaning blades 53, 54 are not mounted at an appropriate angle with respect to the transfer belt 50. Accordingly, when the cleaning blades 53, 54 are pressed against the transfer belt 50 with a large force, the transfer belt 50 warps and consequently the cleaning blades cannot be pressed against the transfer belt 50 at the appropriate angle. In consideration of this disadvantage, as shown in FIGS. 6 and 7, the cleaning blade 53 is disposed in pressing contact with the transfer belt 50 at the circumferential surface of the drive roller 51 or the placing member 55 is disposed in a position opposed to the cleaning blade 54 through the transfer belt 50. In this way, it has been necessary to mount the cleaning blades 53, 54 in pressing contact with the transfer belt 50 while adjusting suitably the relationship between the pressing forces of the cleaning blades 53, 54 against the transfer belt 50 and the warping of the transfer belt 50 caused by these pressing forces.

However, if the cleaning blades 53, 54 are mounted in pressing contact with the transfer belt 50 using the drive roller 51 or the placing member 55, the transfer belt is held between the cleaning blades 53, 54 and the drive roller 51 or the placing member 55 and thereby a torque of the transfer belt 50 increases. The increased torque of the transfer belt 50 causes undesirably the slipping between the transfer belt 50 and the drive roller 51. This is extremely disadvantageous in terms of a sheet transporting performance, an image transferring timing, etc.

SUMMARY OF THE INVENTION

In view of the above described problem, it is an object of the invention to provide a cleaning device for a transfer belt of an image forming apparatus which has a simple construction and is capable of cleaning the transfer belt effectively over a long time without increasing a torque of the transfer belt.

Accordingly, the present invention is directed to a cleaning device for cleaning an endless transfer belt which is made of elastic material and stretched between a first roller and a second roller, one of the two rollers being adapted for driving the belt, the transfer belt being able to come into contact with a copy sheet on one stretch side thereof to convey the copy sheet in a direction from the first roller to the second roller, the cleaning device comprising: a cleaning blade member for removing toner from the belt, the cleaning blade member being disposed on the other stretch side of the transfer belt and near the second roller, being pressed against an outside surface of the belt, and having a leading end portion capable of coming into a line contact with the belt over an entire width of the belt when the belt being driven.

With thus constructed cleaning device, toner attached on the belt is removed by the cleaning blade member when the belt is rotated. In the rotation of the belt, the leading end portion of the cleaning blade member is liable to bend in the rotating direction due to the friction between the leading end and the belt. However, the arrangement of the cleaning blade member near the second roller can assure the line contact between the leading end of the cleaning blade member and the belt even if the leading end portion bends due to the rotation of the belt. Specifically, the belt pushes the cleaning blade member in an outward direction owing to the elasticity of the belt. On the other hand, the bent leading end portion of the cleaning blade member has a restoring force. These forces synergistically act to ensure the line contact over the entire width of the belt. The restoring force of the leading end portion enhances the toner removing performance of the cleaning blade member. Thus, a desirable cleaning performance can be obtained.

Further, the cleaning device may be further provided with an auxiliary roller either between the first roller and the second roller on the other stretch side and in contact with an inside surface of the belt or between the first roller and the second roller on the other stretch side and in contact with an inside surface of the belt, and the cleaning blade member being disposed either between the second roller and the auxiliary roller and near the second roller or between the first roller and the auxiliary roller and near the auxiliary roller.

With this construction, the cleaning blade member is disposed either between the second roller and the auxiliary roller or between the first roller and the auxiliary roller. This reduces the indention portion of the belt which is caused by the pressing force of the cleaning blade member, and consequently reduces the expanding amount of the belt. Accordingly, the pressing force of the cleaning blade member against the belt can be maintained at a specified constant value suitable for cleaning.

It may be appropriate to further provide sensor means for measuring the temperature of the belt; moving means for moving the cleaning blade member in pressing and releasing directions; and controller means for calculating based on a measured temperature an appropriate moving amount of the cleaning blade member to keep the pressing force of the cleaning blade member against the belt at a constant value irrespective of the temperature of the belt, and controlling the moving means in accordance with the calculated moving amount.

Also, it may be appropriate to further provide sensor means for measuring the temperature of the belt; moving means for moving the auxiliary roller in pressing and releasing directions; and controller means for calculating based on a measured temperature an appropriate moving amount of the auxiliary roller to keep the pressing force of the cleaning blade member against the belt at a constant value irrespective of the temperature of the belt, and controlling the moving means in accordance with the calculated moving amount.

With these constructions, the moving amount of the cleaning blade member or auxiliary roller is adjusted in accordance with a change in the temperature of the belt. Accordingly, the pressing force of the cleaning member against the belt can be maintained at a constant value even when the belt is expanded or contracted depending on a change in the temperature of the belt.

Further, it may be preferable to render the cleaning blade member pressed in a direction perpendicular to an outside surface of the belt. This can obviate the cumbersome operation residing in the prior art which adjusts minutely the pressing force of the blade against the belt in relation to an angle at which the blade is in contact with the belt.

The above and other objects, features and advantages of the present invention will become more apparent upon a reading of the following detailed description and drawings.

DETAILED DESCRIPTION OF THE PREFERRED EMBODIMENTS OF THE INVENTION

Figure 3:
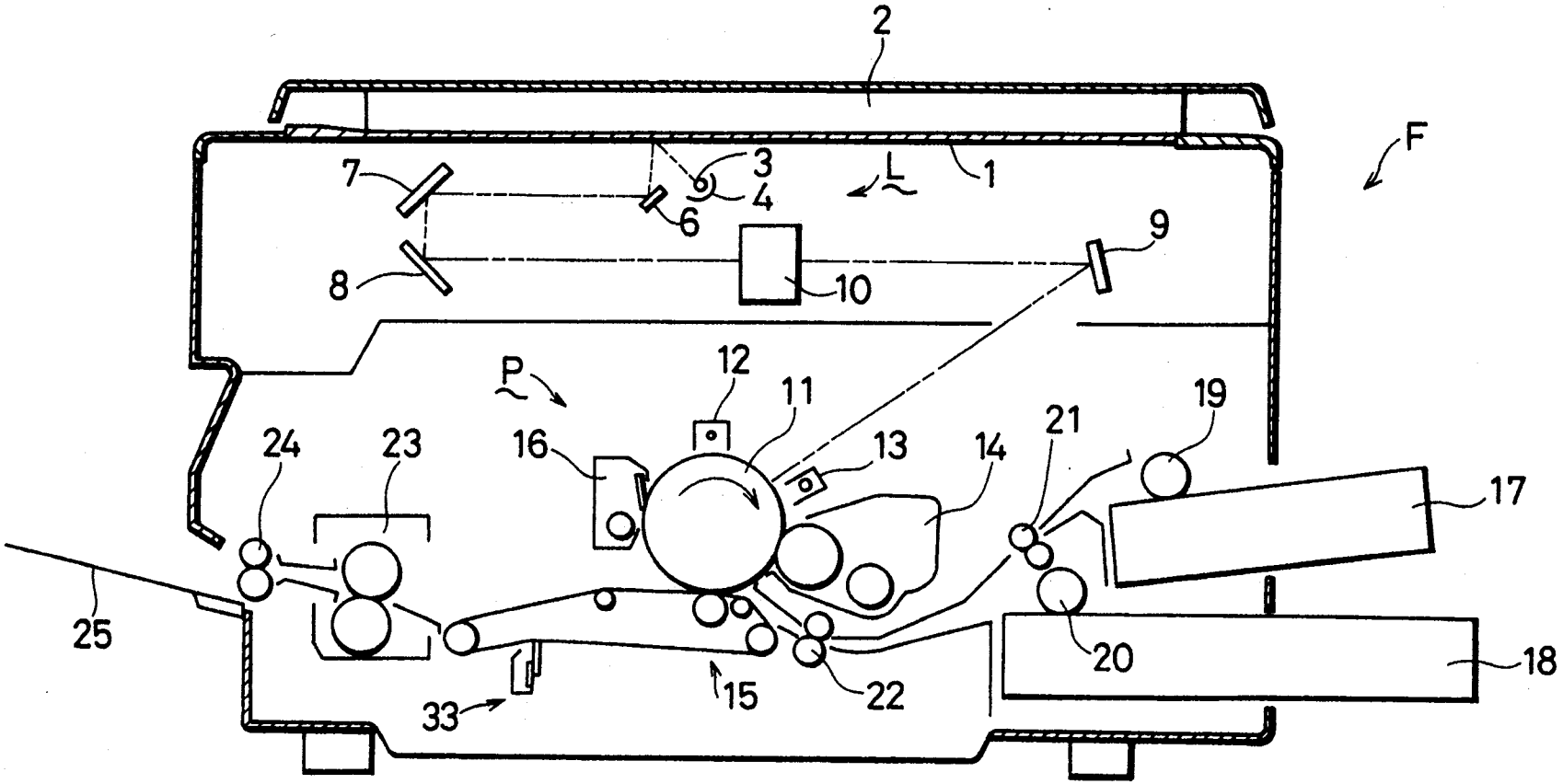
FIG. 3 is a schematic diagram showing an overall construction of a copying machine incorporating the cleaning device according to the invention.

There will be first described a copying machine F (image forming apparatus) incorporating a cleaning device for a transfer belt according to the invention with reference to FIG. 3.

The copying machine F includes a transparent document platen 1 and a document holder 2 in an upper portion thereof, and an optical assembly L, an imaging assembly P, a sheet transport assembly, and other elements in the interior thereof.

The optical assembly L includes a light source unit, reflecting mirrors 6, 7, 8 which forms an optical path by reflecting the reflected light from a document, a lens 10 for adjusting a magnification of an image to be formed, and a fixed mirror 9 for directing the reflected light to a photosensitive drum 11 to be described later. The light source unit has an exposure lamp 3 and a reflecting plate 4, and moves reciprocally to scan a document image.

The imaging assembly P includes a photosensitive drum 11 on the surface of which an electrostatic image is formed, a charger 12 for charging the drum 11 to have a specified surface potential, a blank lamp 13 for removing electric charges in an unnecessary portion on the drum 11, a developing device 14 for attaching toner to the electrostatic image on the drum 11 to develop the same into a toner image, a transfer device 15, a cleaning device 16 for cleaning the toner remaining on the surface of the drum 11. The transfer device 15 transfers the toner image to a copy sheet; separates the copy sheet from the drum 11; and transports the copy sheet further to a downstream side. Indicated at 33 is a cleaning device for cleaning the toner attached to the transfer device 15. The transfer and cleaning devices 15, 33 will be described more in detail later.

The transport assembly includes cassettes 17, 18 in which differently sized copy sheets can be contained, feed rollers 19, 20 for dispensing copy sheets from the cassettes 17, 18, a pair of transport rollers 21, a pair of registration rollers 22, etc. in this order from an upstream side with respect to a sheet transport direction. The transport assembly also includes a fixing device 23, a pair of discharge rollers 24, etc. to transport the image bearing copy sheet to a further downstream side. The fixing device 23 fixes the toner image transferred to the copy sheet onto the copy sheet, and the discharge rollers 24 discharge the copy sheet onto a discharge tray 25.

In the copying machine thus constructed, the light emitted from the exposure lamp 3 is reflected by the document surface and the reflected light representing the document image is introduced to the photosensitive drum 11 through the reflecting mirror 6, 7, 8, the lens 10, and the fixed mirror 9. The drum 11 is charged by the charger 12 to have the specified sur face potential while rotating in a direction of arrow. The charged surface of the drum 11 is exposed to the light from the optical assembly L, and thereby an electrostatic image is formed thereon. The electrostatic image formed on the drum 11 is transferred to the copy sheet fed from the cassette 17 or 18 by the transfer device 15 after being developed by the developing device 14. The copy sheet bearing the toner image is separated from the drum 11 and transported by the transfer device 15, and is discharged onto the discharge tray 25 through the fixing device 23 and the discharge rollers 24.

Figure 1:
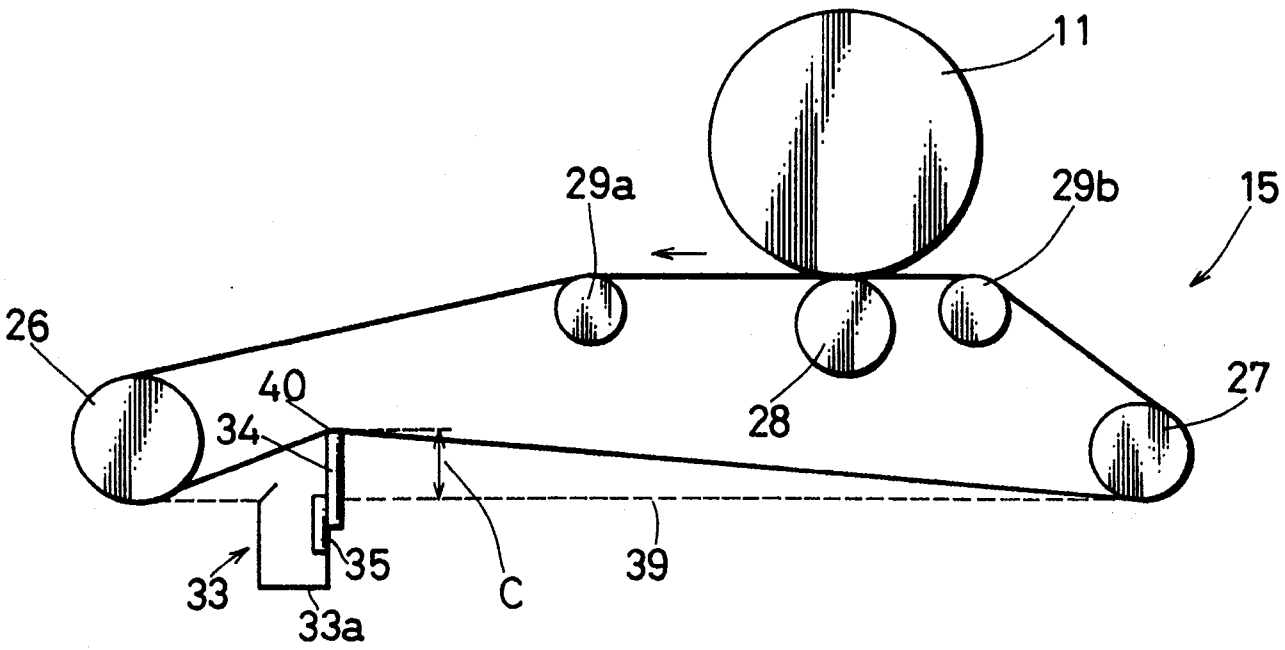
FIG. 1 is a schematic diagram showing a construction of cleaning device for a transfer belt according to the invention as a first embodiment.
Figure 2:
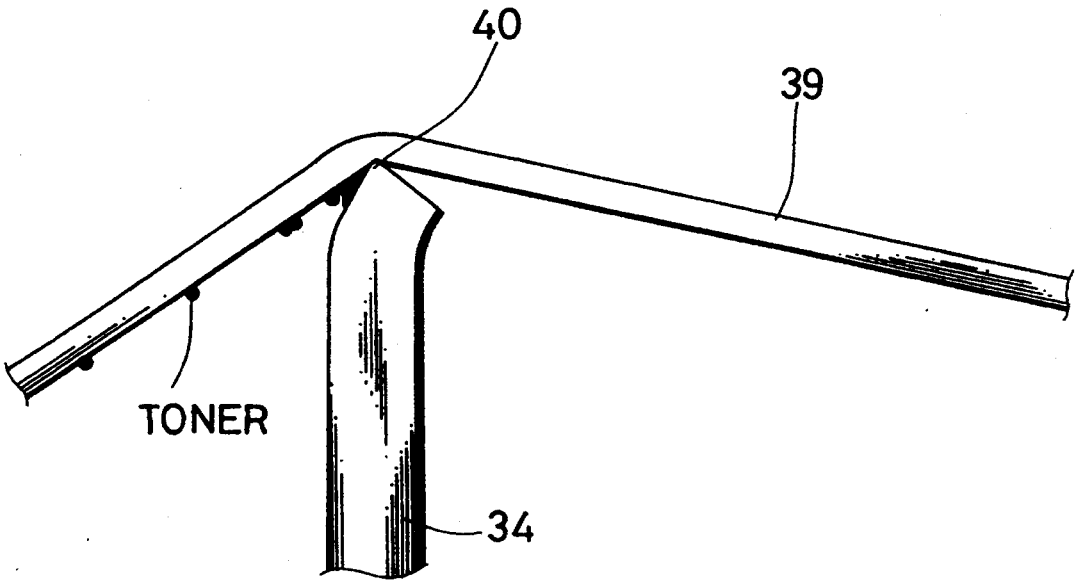
FIG. 2 is a schematic diagram showing enlargedly a state where a cleaning blade is in contact with a transfer belt in the cleaning device.

There will be described a specific construction of the transfer and cleaning devices 15, 33 as a first embodiment with reference to FIGS. 1 and 2. In these figures, the transfer device 15 includes a transfer belt 39, a charging roller 28, and the cleaning device 33. The transfer belt 39 separates the copy sheet from the drum 11 and transports the same further to the downstream side. To the charging roller 28 is applied a specified voltage, so that the toner image formed on the surface of the drum 11 is transferred to the copy sheet on the belt 39. The cleaning device 33 removes the toner attached to the surface of the belt 39.

The transfer belt 39 is an endless belt formed of urethane rubber or the like, and fluoro-coating is applied to the surface thereof. The belt 39 is stretched on a drive roller 26 disposed right upstream from the fixing device 23, a driven roller 27 disposed right downstream from the registration rollers 22, and intermediate rollers 29*a*, 29*b* which are grounded. The drive roller 29 is caused to rotate by an unillustrated motor, and thereby the belt 39 rotates in a direction of arrow in FIG. 1.

The charging roller 28 is disposed in a position opposed to the photosensitive drum 11 while holding the transfer belt 39 therebetween. The outer circumferential surface of the roller 28 is in contact with the inner circumferential surface of the belt 39. The roller 28 applies a high voltage supplied from an unillustrated transformer to the belt 39 at a specified timing. In this way, the toner image formed on the surface of the drum 11 is transferred to the copy sheet on the belt 39. It is understood that the belt 39 is charged a little during the image transfer operation.

The cleaning device 33 is disposed below the transfer belt 39 between the drive and driven rollers 26, 27. The cleaning device 33 is located more toward the drive roller 26. The cleaning device 33 includes a cleaning blade member (hereinafter referred to merely as a blade) for scratching off (removing) the toner attached to the surface of the belt 39. The blade 34 is a plate-like member formed of urethane rubber or the like excellent in, for example, ozone resistance and durability. A leading end face of the blade 34 is in pressing contact with the surface of the belt 39 over the entire width of the belt 39 and a leading edge portion 40 is formed so as to define a desired angle, e.g., right angle, with high accuracy. The blade 34 is supported by a holder 35 and is mounted on a frame of the copying machine F through this holder 35. Indicated at 33*a* is a casing for containing the collected toner.

The cleaning device 33 is disposed such that the leading end of the blade 34 is pressed against the transfer belt 39 vertically above, i.e., normal to the surface of the belt 39. The pressing force of the blade 34 against the belt 39 causes the belt 39 to indent by a specified amount C (indent amount) from a position indicated by broken line. In this embodiment, it is accomplished to have a preferable cleaning performance over a long time by setting the indent amount C at 7 mm when a distance between the drive and driven rollers 26, 27 is 200 mm.

There will be described an operation of thus constructed transfer device 15.

When the registration rollers 22 are driven, thereby transporting the copy sheet to the transfer device 15, the toner image formed on the sur face o f the photosensitive drum 11 is transferred to one face of the copy sheet due to a potential difference between the charging roller 28 and the drum 11. The copy sheet bearing the toner image is transported further to the downstream side while being attached electrostatically to the transfer belt 39; is separated from the belt 39 at the position of the drive roller 26 which is located most downstream in the transfer device 15; and is transferred to the fixing device 23. On the other hand, the toner attached to the belt 39 is removed by the blade 34 of the cleaning device 33 while the belt 39 is rotating, and is contained in the casing 33*a*. The electric charges carried by the belt 39 are removed through the intermediate rollers 29*a*, 29*b*.

There will be described an action of the cleaning device 33 with reference to FIG. 2.

With the cleaning device 33 thus constructed, when the transfer belt 39 is rotated upon the start of the copying operation, the leading end of the blade 34 bends deformably to the downstream side with respect to the rotating direction of the belt 39 due to the frictional force acting between the belt 39 and the leading end of the blade 34. Since the blade 34 is located near the drive roller 26 at this time, only the edge portion 40 of the blade 34 is in contact with the belt 39. In this state, a force to press the edge portion 40 downward is acting on the belt 39 due to the elastic force thereof, whereas a force to restore the bent state of the blade 34 is acting on the edge portion 40. More specifically, the edge portion 40 and the belt 39 are kept firmly in contact with each other by the action of these forces and particularly the force acting on the edge portion 40 acts as a force to scratch off the toner attached to the surface of the transfer belt 39 (edge effect). In this way, the blade 34 cleans the belt 39 satisfactorily.

When the blade 34 is located near the driven roller 27, the blade 34 is in contact with the transfer belt 39 not at only the edge portion 40 as described above but at the entire leading end face. In this case, since the force of the blade 34 to restore from its bent state to its original state is dispersed over the entire leading end face of the blade 34, the blade 34 and the belt 39 cannot be kept firmly in contact. As a result, the blade 34 cannot realize a desired cleaning performance.

There will be described a specific construction of the transfer 15 and cleaning devices 33 as a second embodiment next with reference to FIG. 4. It will be appreciated that, in this figure, like reference numerals denote elements having like functions in FIGS. 1 and 2.

The second embodiment differs from the first embodiment in that: 1) An auxiliary roller 30 is provided between the drive roller 26 and the driven roller 27; 2) A belt temperature sensor is disposed in a position opposed to the driven roller 27; and 3) The cleaning device 33 is further provided with an elevating mechanism for moving the blade 34 upward and downward and a CPU 32 for controlling the elevating mechanism.

The elevating mechanism includes an eccentric cam 37 and a motor 38 for rotating the eccentric cam 37. The outer circumferential surface of the eccentric cam 37 mounted on a drive shaft of the motor 38 is slidably in contact with a horizontal support shaft 36 mounted projectingly on the holder 35 of the blade 34. The motor 38 is caused to rotate in accordance with a control signal from the CPU 32, thereby the blade 34 and the holder 35 move integrally vertically upward or downward. It is noted that an arrangement for supporting the holder 35 movably upward and downward is provided on the frame of the copying machine F. For example, this arrangement may include an oblong hole extending in the vertical direction through which the support shaft 36 is inserted and a guide member extending in the vertical direction.

Figure 4:
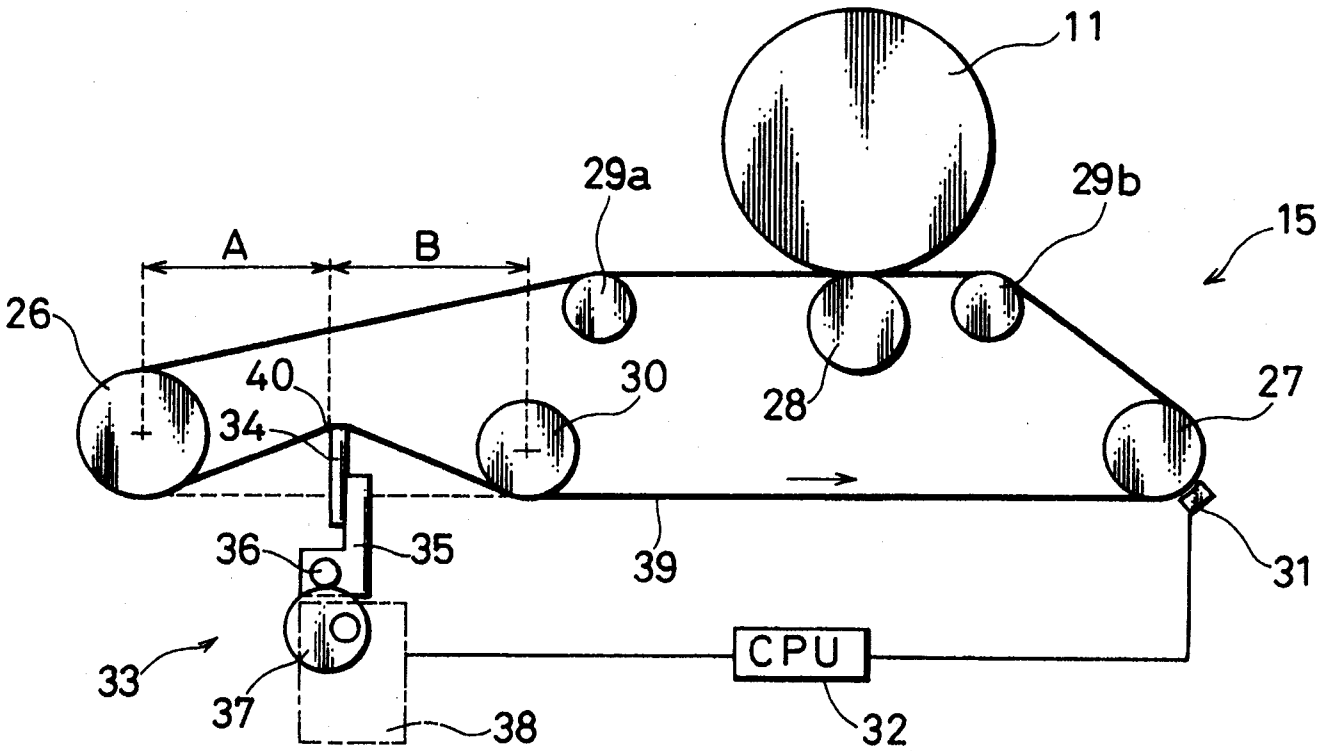
FIG. 4 is a schematic diagram showing a construction of a cleaning device for a transfer belt according to the invention as a second embodiment.

The cleaning device 33 is disposed, as shown in FIG. 4, such that the leading end of the blade 34 is pressed against the transfer belt 39 vertically above between the drive roller 26 and the auxiliary roller 30, i.e., normal to the surface of the belt 39. The pressing force of the blade 34 against the belt 39 causes the belt 39 to indent by a specified indent amount from a position indicated by broken line. For example, when a distance between the driven and driven rollers 26, 27 is 200 mm, the auxiliary roller 30 is disposed about 30 mm away from the drive roller 26 and the cleaning device 33 is disposed at least slightly toward the drive roller 26 from a middle point between the drive and auxiliary rollers 26, 30 (in FIG. 4, $A<B$).

Incidentally, the urethane rubber of which the transfer belt 39 is formed has a specific degree of expansion in relation to a temperature (e.g., 5%/20° C.). The shorter the belt between rollers, the smaller the degree of expansion therebetween. Accordingly, as in this embodiment, a stretchable range of the belt 39 pressed by the blade 34 is narrowed by provided the auxiliary roller 30, thereby enabling the degree of expansion of the belt 39 to be minimized. In view of this, the blade 34 is brought into pressing contact with the belt 39 between the drive and auxiliary rollers 26, 30 in order to maintain the actual pressing force of the blade 34 against the belt 39 in a desired range.

There will be described an operation of the cleaning device 33 in the second embodiment.

The CPU 32 reads a detected temperature data of the transfer belt 39 from the belt temperature sensor 31. Based on this temperature data, the CPU 32 calculates the degree of expansion of the belt 39 or obtains the same from a conversion table. Based on this calculation result, the CPU 32 calculates an elevating amount of the blade 34, i.e., how much the blade 34 is moved upward or downward. In fact, the CPU 32 obtains an amount by which the motor 38 should be driven. Subsequently, the CPU 32 outputs a control signal to the motor 38 so as to move the blade 34 upward or downward by the calculated elevating amount, and stores the elevating amount in a memory provided, for example, in the CPU 32. In other words, the pressing force of the blade 34 against the belt 39 is maintained substantially at the same value by increasing or decreasing the indent amount of the belt 39 caused by the blade 34 according to the expansion of the belt 39.

There will be next described an action of this cleaning device 33. Since the blade 34 is located at a position where the distance A is at least shorter than the distance B, only the edge portion 40 of the blade 34 is in contact with the belt 39. Accordingly, as described with reference to FIG. 2, the force acting on the edge portion 40 acts as force to scratch off the toner attached to the surface of the transfer belt 39 (edge effect) and the blade 34 cleans the belt 39 satisfactorily. When $A>B$, the force of the blade 34 to restore from its bent state to its original state is dispersed over the entire leading end face of the blade 34 as described above, thus the blade 34 and the belt 39 cannot be kept firmly in contact. As a result, the blade 34 cannot realize a desired cleaning performance.

Figure 5:
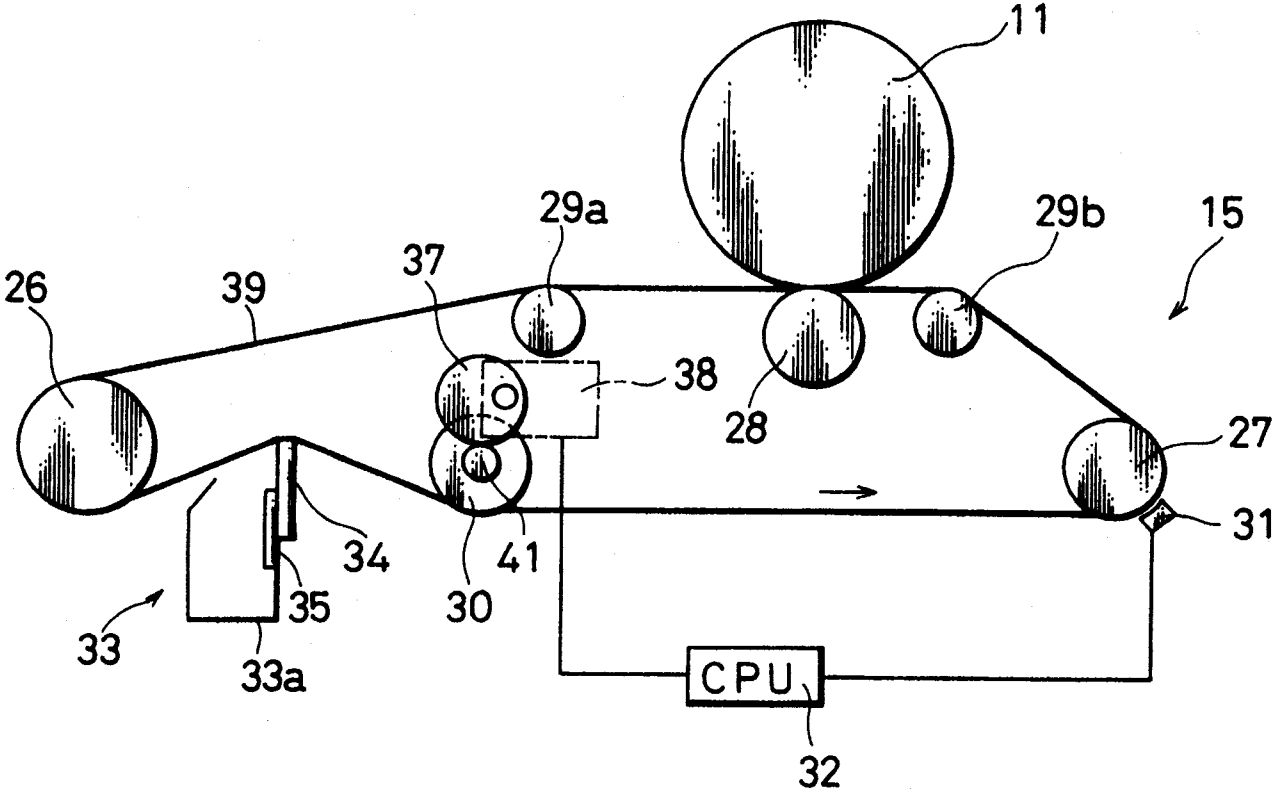
FIG. 5 is a schematic diagram showing a construction of a cleaning device for a transfer belt according to the invention as a third embodiment.

There will be described a specific construction of the transfer 15 and cleaning devices 33 as a third embodiment next with reference to FIG. 5. It will be appreciated that, in this figure, like reference numerals denote elements having like functions in FIG. 4.

The third embodiment differs from the second embodiment in that an elevating mechanism for moving the auxiliary roller 30 upward and downward in place of the elevating mechanism of the cleaning device 33. Specifically, the outer circumferential surface of an eccentric cam 37 is slidably in contact with a rotatable shaft 41 of the auxiliary roller 30. This eccentric cam 37 is rotated by the motor 38 to thereby move the auxiliary roller 30 upward and downward, i.e. to move the auxiliary roller toward and away from the transfer belt 39. In this way, the pressing force of the blade 34 against the belt 39 is maintained stably. It is understood that the rotatable shaft 41 is supported rotatably in an oblong hole formed in the frame of the copying machine F. The CPU 32 calculates the elevating amount of the auxiliary roller 30 based on the detected temperature data from the belt temperature sensor 31 and controls the rotation of the motor 38 based on the calculated ed elevating amount.

Although the auxiliary roller 30 and the elevating mechanism are employed in the second and third embodiments, the invention is not limited to such a construction. The invention can be embodied in the transfer device 15 including only the auxiliary roller 30 without the elevating mechanism.

As described above, in a cleaning device for a transfer belt according to the invention, a blade 34 is brought into pressing contact with a transfer belt 39 in a direction normal to the surface of the belt 39 and only a downstream edge portion 40 of a leading end of the blade 34 is kept in pressing contact with the surface of the belt 39, making use of the deformable bending of the blade 34 due to the rotation of the belt 39. Accordingly, a desirable cleaning performance can be obtained over a long time only by bringing the blade 34 to contact with the belt 39 from a direction normal to the surface of the belt 39. This obviates the need for a cumbersome operation for adjusting minutely the pressing force of the blade against the transfer belt in relation to an angle at which the blade is in contact with the transfer belt as in a case of the prior art where the driven roller and the placing member are utilized. Further, since the transfer belt is not held between the blade and the driven roller or is not slidable in contact with the placing member, there will be no undesirable increase in the torque of the transfer belt 33. Thus, this cleaning device 33 is free from the slipping between the transfer belt 39 and the drive roller 26.

Figure 6:
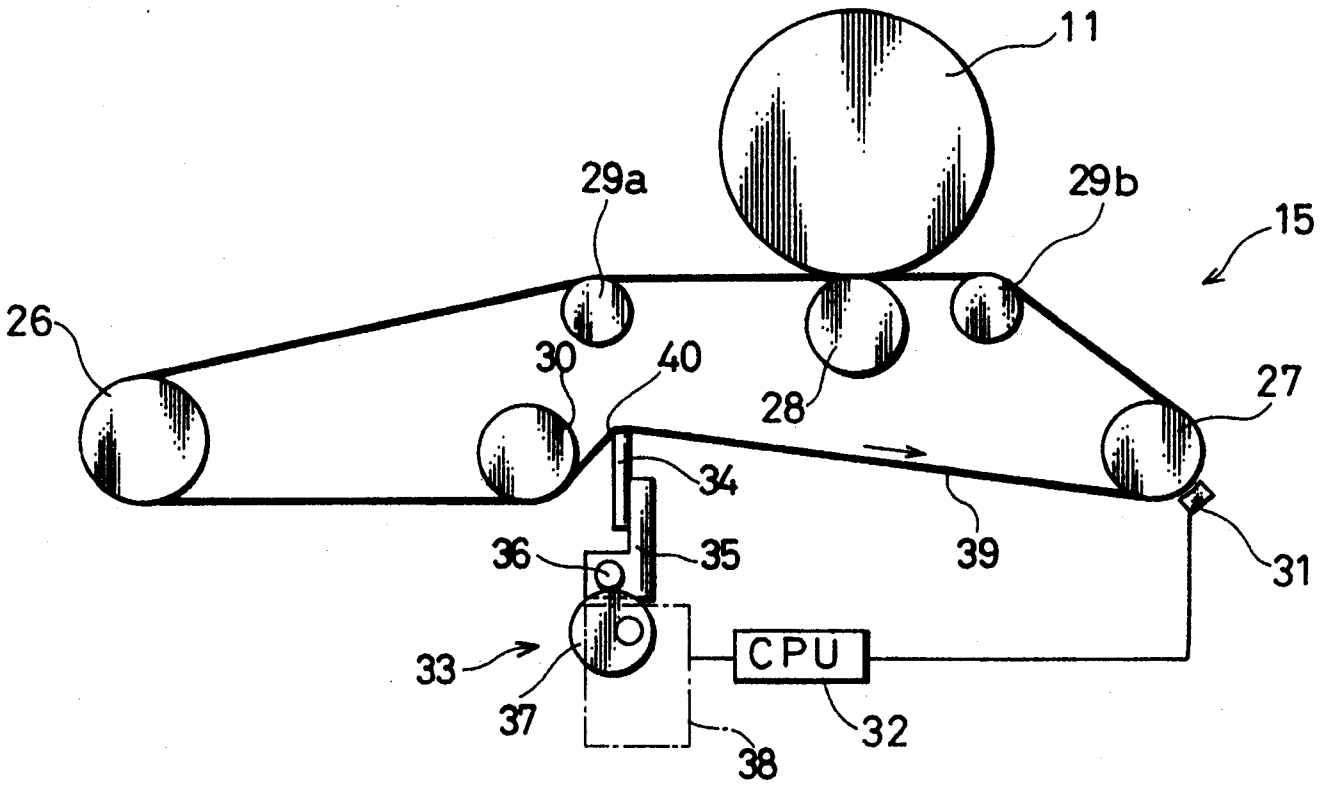
FIG. 6 is a schematic diagram showing a construction of a cleaning device for a transfer belt according to the invention as a fourth embodiment.
Figure 7:
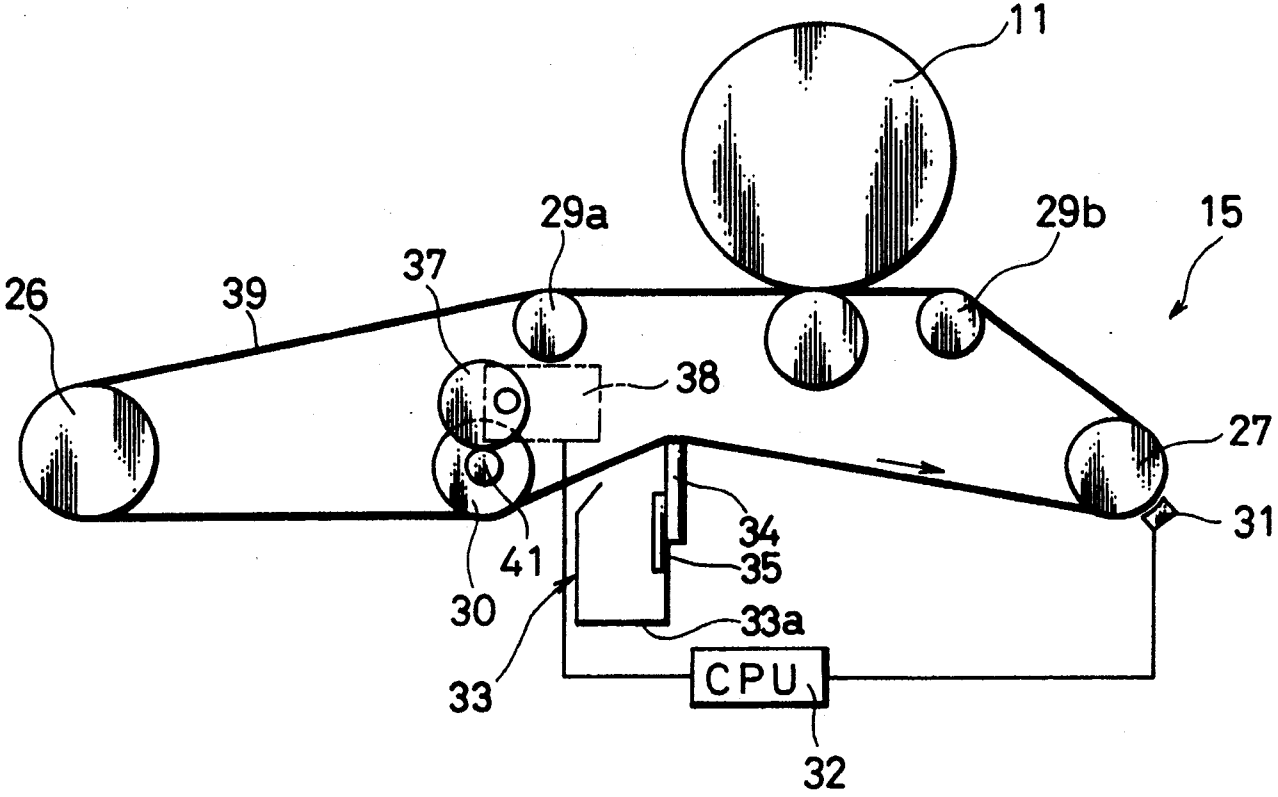
FIG. 7 is a schematic diagram showing a construction of a cleaning device for a transfer belt according to the invention as a fifth embodiment.
Figure 8:
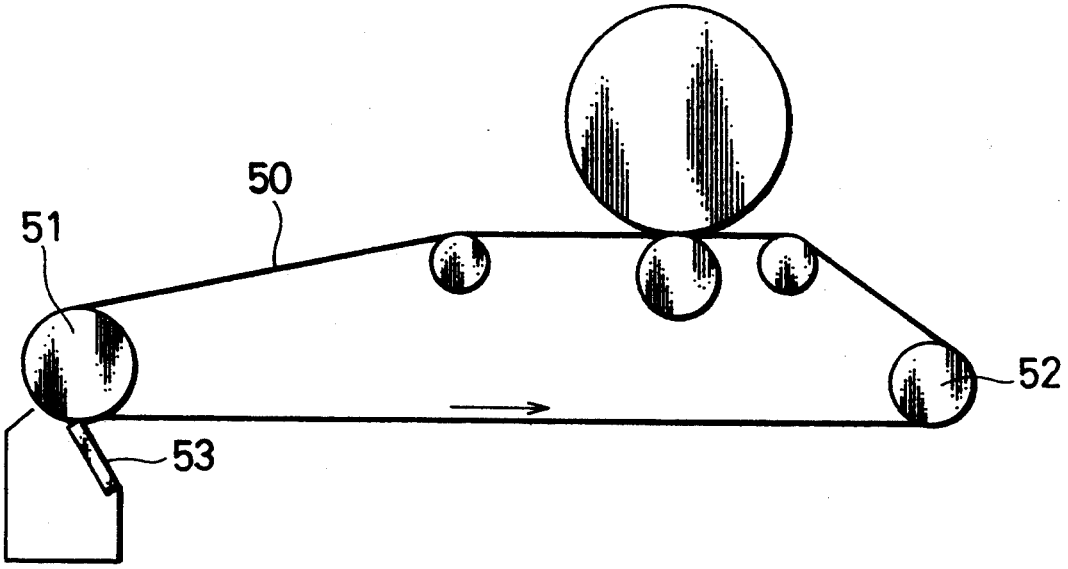
PRIOR ART FIG. 8
FIG. 8 is a schematic diagram showing a construction of an exemplary conventional counter type cleaning device for a transfer belt.
Figure 9:
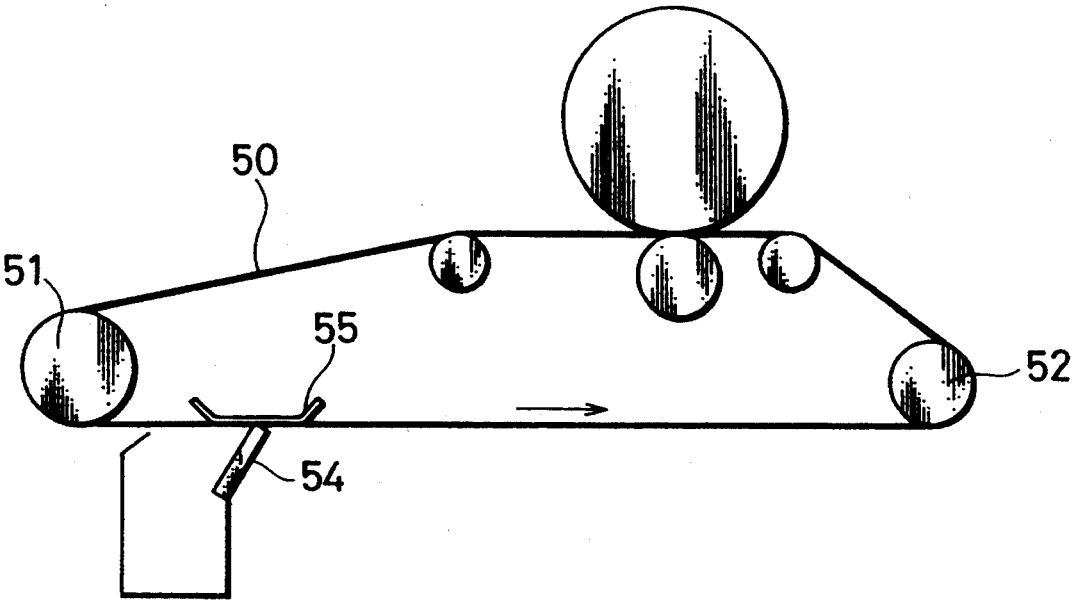
PRIOR ART FIG. 9
FIG. 9 is a schematic diagram showing a construction of an exemplary conventional trail type cleaning device for a transfer belt.

It may be also appropriate to dispose the cleaning device 33 in a position closer to the auxiliary roller 30 between the driven roller 27 and the auxiliary roller 30 in such a manner that the blade 34 is in pressing contact with the transfer belt 39 FIGS. 6 and 7. More specifically, FIG. 6 shows a fourth embodiment which has the same construction as the second embodiment except for the cleaning device 33 being disposed between the auxiliary roller 30 and the driven roller 27. FIG. 7 shows a fifth embodiment which has the same construction except for the cleaning device 33 being disposed between the auxiliary roller 30 and the driven roller 27. This arrangement also ensures effects similar to the ones obtained in the second and third embodiments. The elevating mechanism is not limited to the eccentric cam, but may be a crank mechanism or sliding mechanism. Further, the material for the blade 34 is not limited to an elastic material such as urethane rubber, but may be a material having a certain rigidity.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A cleaning device for cleaning an endless transfer belt which is made of elastic material and stretched between a first roller and a second roller, one of the two rollers being adapted for driving the belt, the transfer belt being able to come into contact with a copy sheet on one stretch side thereof to convey the copy sheet in a direction from the first roller to the second roller, the cleaning device comprising:

a cleaning blade member for removing toner from the belt, the cleaning blade member;

being disposed on the other stretch side of the transfer belt and near the second roller;

being pressed against an outside surface of the belt; and having a leading end portion capable of coming into a line contact with the belt over an entire width of the belt when the belt is driven;

sensor means for measuring the temperature of the belt;

moving means for moving the cleaning blade member in pressing and releasing directions; and controller means for calculating based on a measured temperature an appropriate moving amount of the cleaning blade member to keep the pressing force of the cleaning blade member against the belt at a constant value irrespective of the temperature of the belt, and controlling the moving means in accordance with the calculated moving amount.

2. A cleaning device for cleaning an endless transfer belt which is made of elastic material and stretched between a first roller and a second roller, one of the two rollers being adapted for driving the belt, the transfer belt being able to come into contact with a copy sheet on one stretch side thereof to convey the copy sheet in a direction from the first roller to the second roller, the cleaning device comprising:

a cleaning blade member for removing toner from the belt, the cleaning blade member;

being disposed on the other stretch side of the transfer belt and near the second roller;

being pressed against an outside surface of the belt; and having a leading end portion capable of coming into a line contact with the belt over an entire width of the belt when the belt is driven;

an auxiliary roller provided between the first roller and the second roller on the other stretch side and in contact with an inside surface of the belt, wherein the cleaning blade member is disposed between the second roller and the auxiliary roller and near the second roller;.

sensor means for measuring the temperature of the belt;

moving means for moving the auxiliary roller in pressing and releasing directions; and controller means for calculating based on a measured temperature an appropriate moving amount of the auxiliary roller to keep the pressing force of the cleaning blade member against the belt at a constant value irrespective of the temperature of the belt, and controlling the moving means in accordance with the calculated moving amount.

3. A cleaning device for cleaning an endless transfer belt which is made of elastic material and stretched between a first roller and a second roller, one of the two rollers being adapted for driving the belt, the transfer belt being able to come into contact with a copy sheet on one stretch side thereof to convey the copy sheet in a direction from the first roller to the second roller, the cleaning device comprising:

a cleaning blade member for removing toner from the belt, the cleaning blade member;

being disposed on the other stretch side of the transfer belt and near the second roller;

being pressed against an outside surface of the belt; and having a leading end portion capable of coming into a line contact with the belt over an entire width of the belt when the belt is driven;

an auxiliary roller provided between the first roller and the second roller on the other stretch side and in contact with an inside surface of the belt, wherein the cleaning blade member is disposed between the first roller and the auxiliary roller and near the auxiliary roller;

sensor means for measuring the temperature of the belt;

moving means for moving the auxiliary roller in pressing and releasing directions; and controller means for calculating based on a measured temperature an appropriate moving amount of the auxiliary roller to keep the pressing force of the cleaning blade member against the belt at a constant value irrespective of the temperature of the belt, and controlling the moving means in accordance with the calculated moving amount.

4. A cleaning device comprising an endless transfer belt having material thereon to be cleaned, first and second rollers spaced from one another, each of said first and second rollers having a center of rotation, each of said first and second rollers having an outer periphery, said endless transfer belt having a belt section which passes from the outer periphery of said first roller to the outer periphery of said second roller, said outer periphery of said first and second rollers defining a straight line path which extends tangentially from the outer periphery of said first roller and tangentially from the outer periphery of said second roller and which is parallel to a line connecting the centers of rotation of said first and second rollers, a cleaning blade means for removing said material from said belt, said cleaning blade means being disposed along said belt section spaced from said first and second rollers, and supporting means supporting said cleaning blade means against said belt section such that said belt section is deviated from said straight line path, said cleaning blade means comprising an elongated cleaning blade member having a longitudinal axis, said longitudinal axis being disposed perpendicular to said straight line path, said cleaning blade means being made of a resilient material, said cleaning blade means comprising an elongated cleaning blade member having an elongate axis, said cleaning blade member having a main portion and a terminating end portion, said elongate axis having a main elongate axis portion extending along said main portion of said cleaning blade member, said elongate axis having a terminating end elongate axis portion extending along said terminating end portion of said cleaning blade member, said terminating end portion of said cleaning blade member having an unflexed state in which said main elongate axis portion is substantially linearly aligned with said terminating end elongate axis portion, said terminating end portion of said cleaning blade member having a flexed state in which said terminating end elongate axis portion is disposed at an obtuse angle relative to said main elongate axis portion, said supporting means being operable to force said terminating end portion of said cleaning blade member against said belt section to thereby force said terminating end portion of said cleaning blade member into said flexed state, said section traveling from said first roller to said second roller, said cleaning blade member having a leading face and a trailing face, said leading face facing said first roller, said trailing face facing said second roller, said leading face having a main leading face section on said main portion of said cleaning blade member, said trailing face having a main trailing face section on said main portion of said cleaning blade member, said cleaning blade member having a terminating end leading face section on said terminating end portion of said cleaning blade member, said trailing face having a terminating end trailing face section on said terminating end portion of said cleaning blade member, said terminating end leading face section being disposed at an obtuse angle relative to said main leading face section when said terminating end portion is in said flexed state, said terminating end portion having a terminating end surface, said terminating end leading face section intersecting said terminating end surface along a leading edge, said leading edge engaging said belt section when said cleaning blade member is in said flexed state, said terminating end surface forming an acute angle with the part of the belt section which extends from said leading edge to said second roller when said cleaning blade means is in said flexed state.

5. A cleaning device secondary to claim 4 wherein said straight line path defined by said first and second rollers has a first end disposed on the periphery of said first roller and a second end disposed on the periphery of said second roller, said cleaning blade means contacting said belt section at a contact position, said belt section having a first belt part which extends from said first end of said straight line path to said contact position, said belt section having a second belt part which extends from said contact position to said second end of said straight line path, said first belt part being disposes at an obtuse angle relative to said second belt part.

6. A cleaning device according to claim 5 wherein said belt section travels from said first roller to said second roller during cleaning, said first belt part being delineated an upstream belt part said second belt part being delineated a downstream belt part, said downstream belt part being longer than said upstream belt part.

7. A cleaning device according to claim 4 wherein said terminating end trailing face section is disposed at an obtuse angle relative to said main trailing face section when said terminating end portion is in said flexed state.

8. A cleaning device according to claim 4 wherein said terminating end leading face section forms an acute angle with the part of the belt section which extends from said first roller to said leading edge when said cleaning blade member is said flexed state.

9. A cleaning device comprising an endless transfer belt having material thereon to be cleaned, first and second rollers spaced from one another, each of said first and second rollers having a center of rotation, each of said first and second rollers having an outer periphery, said endless transfer belt having a belt section which passes from the outer periphery of said first roller to the outer periphery of said second roller, said outer periphery of said first and second rollers defining a straight line path which extends tangentially from the outer periphery of said first roller and tangentially from the outer periphery of said second roller and which is parallel to a line connecting the centers of rotation of said first and second rollers, a cleaning blade means for removing said material from said belt, said cleaning blade means being disposed along said belt section spaced from said first and second rollers, and supporting means supporting said cleaning blade means against said belt section such that said belt section is deviated from said straight line path, said cleaning blade means comprising an elongated cleaning blade member having a longitudinal axis, said longitudinal axis being disposed perpendicular to said straight line path, said cleaning blade means being made of a resilient material, said cleaning blade means comprising an elongated cleaning blade member having an elongate axis, said cleaning blade member having a main portion and a terminating end portion, said elongate axis having a main elongate axis portion extending along said main portion of said cleaning blade member, said elongate axis having a terminating end elongate axis portion extending along said terminating end portion of said cleaning blade member, said terminating end portion of said cleaning blade member having an unflexed state in which said main elongate axis portion is substantially linearly aligned with said terminating end elongate axis portion, said terminating end portion of said cleaning blade member having a flexed state in which said terminating end elongate axis portion is disposed at an obtuse angle relative to said main elongate axis portion, said supporting means being operable to force said terminating end portion of said cleaning blade member against said belt section to thereby force said terminating end portion of said cleaning blade member into said flexed state, said section traveling from said first roller to said second roller, said cleaning blade member having a leading face and a trailing face, said leading face facing said first roller, said trailing face facing said second roller, said leading face having a main leading face section on said main portion of said cleaning blade member, said trailing face having a main trailing face section on said main portion of said cleaning blade member, said cleaning blade member having a terminating end leading face section on said terminating end portion of said cleaning blade member, said trailing face having a terminating end trailing face section on said terminating end portion of said cleaning blade member, said terminating end leading face section being disposed at an obtuse angle relative to said main leading face section when said terminating end portion is in said flexed state, said terminating end portion having a terminating end surface, said terminating end leading face section intersecting said terminating end surface along a leading edge, said leading edge engaging said belt section when said cleaning blade member is in said flexed state, said terminating end surface being spaced from said belt section when said cleaning blade means is in said flexed state.

* * * * *